US009039583B2

(12) United States Patent
Huang

(10) Patent No.: US 9,039,583 B2
(45) Date of Patent: May 26, 2015

(54) FOOT EXERCISE MACHINE

(71) Applicant: Chin-Chen Huang, Changhus Hsien (TW)

(72) Inventor: Chin-Chen Huang, Changhus Hsien (TW)

( * ) Notice: Subject to any disclaimer, the term of this patent is extended or adjusted under 35 U.S.C. 154(b) by 171 days.

(21) Appl. No.: 13/846,916

(22) Filed: Mar. 18, 2013

(65) Prior Publication Data

US 2014/0274585 A1 Sep. 18, 2014

(51) Int. Cl.

| | |
|---|---|
| ***A63B 23/08*** | (2006.01) |
| ***A63B 23/10*** | (2006.01) |
| ***A63B 22/04*** | (2006.01) |
| ***A63B 21/02*** | (2006.01) |
| ***A63B 21/04*** | (2006.01) |
| ***A63B 21/00*** | (2006.01) |
| ***A63B 21/055*** | (2006.01) |

(52) U.S. Cl.

CPC ..... *A63B 23/10* (2013.01); *A63B 21/00098* (2013.04); *A63B 21/0552* (2013.01)

(58) Field of Classification Search

CPC ..... A63B 21/0442; A63B 22/0048; A63B 22/0056; A63B 22/0058; A63B 22/0064; A63B 22/0069; A63B 22/14; A63B 22/16; A63B 22/18; A63B 26/003; A63B 23/10; A63B 21/00098; A63B 21/0552

USPC ..... 482/79–80, 121–123, 126, 129–130, 482/133, 135–138, 142, 146–147, 52–53

See application file for complete search history.

(56) References Cited

U.S. PATENT DOCUMENTS

| | | | | |
|---|---|---|---|---|
| 3,511,500 | A * | 5/1970 | Dunn | 482/113 |
| 3,582,066 | A * | 6/1971 | Keryluk | 482/71 |
| D390,020 | S * | 2/1998 | Huang | D6/349 |
| 7,008,359 | B2 * | 3/2006 | Fan et al. | 482/146 |
| 7,364,534 | B2 * | 4/2008 | Zoller et al. | 482/80 |
| 8,109,860 | B2 * | 2/2012 | Lo | 482/51 |
| 2006/0240950 | A1 * | 10/2006 | Chang | 482/52 |

* cited by examiner

*Primary Examiner* — Loan H Thanh
*Assistant Examiner* — Jennifer M Deichl

(57) ABSTRACT

A foot exercise machine has a base, a rotation disk, a linkage rod, a pedal, two elastic ropes, two elastic strips and two elastic pulling strings. The foot exercise machine having simple structure and light weight. The manufacturing cost of the foot exercise machine is lower so it is more approachable for everyone. The foot exercise machine can also improve user's balance skill.

10 Claims, 7 Drawing Sheets

FOOT EXERCISE MACHINE

BACKGROUND OF THE INVENTION

1. Field of the Invention

The present invention relates to a foot exercise machine, and more particularly to a foot exercise machine having simple structure and light weight.

2. Description of the Related Art

Modern life causes stressful life style and no time for exercising. Regular exercise habit helps to improve health condition and reduce body fat. However, most of exercise devices are huge and expensive, which is not economical for most of user.

Therefore, it is desirable to provide foot exercise machine having simple structure and light weight to mitigate and/or obviate the aforementioned problems.

SUMMARY OF THE INVENTION

An objective of the present invention is to provide A foot exercise machine having simple structure and light weight.

In order to achieve the above mentioned objective, a foot exercise machine includes a base, a rotation disk, a linkage rod, a pedal, two elastic ropes, two elastic strips and two elastic pulling strings. A chamber is disposed on the base and the rotation disk pivotly mounted in the chamber; the base has at least four securing apertures respectively on four corners, which has a C-shaped indentation accepting an elastic sheet and a positioning protrusion is disposed on a top face of the elastic sheet. The rotation disk is a rounded cap and has two opposite pivoting ears having a pivoting aperture, such that an accepting space is provided between the two pivoting ears. A plurality of positioning teeth disposed around a bottom periphery of the rotation disk and making contact with the positioning protrusion of the elastic sheet make contact. Two ends of the linkage rod are respectively provided with a pivoting aperture with a direction perpendicular with each other, one end of the linkage rod is inserted into the accepting space of the rotation disk and attached with two torsion springs at two sides, a pivoting shaft is inserted through the pivoting aperture and the torsion spring to secure the linkage rod onto the pivoting ear of the rotation disk and maintain the linkage rod up vertically. Two sides of the pedal are respectively provided with a stepping area, each stepping area has an engaging portion at an outer edge and at least two through apertures at an inner portion. A long slot is provided at a central area of a bottom side of the pedal. A pivoting aperture is provided through the long slot at a central area of the pedal, another end of the linkage rod is accepted in the long slot and a pivoting shaft is placed through the pivoting aperture such that the pedal is positioned off set from the base. Two ends of the elastic rope are respectively placed through the two through apertures of the pedal and the two securing apertures of the base and respectively have an enlarged portion. One end of the elastic strip is secured onto the engaging portion of the pedal and another free end has a plurality of adjusting apertures corresponding to at least one fastening protrusion on the pedal. One end of the elastic pulling string is fastened onto the engaging portion of the pedal and another end is provided with a gripping loop.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
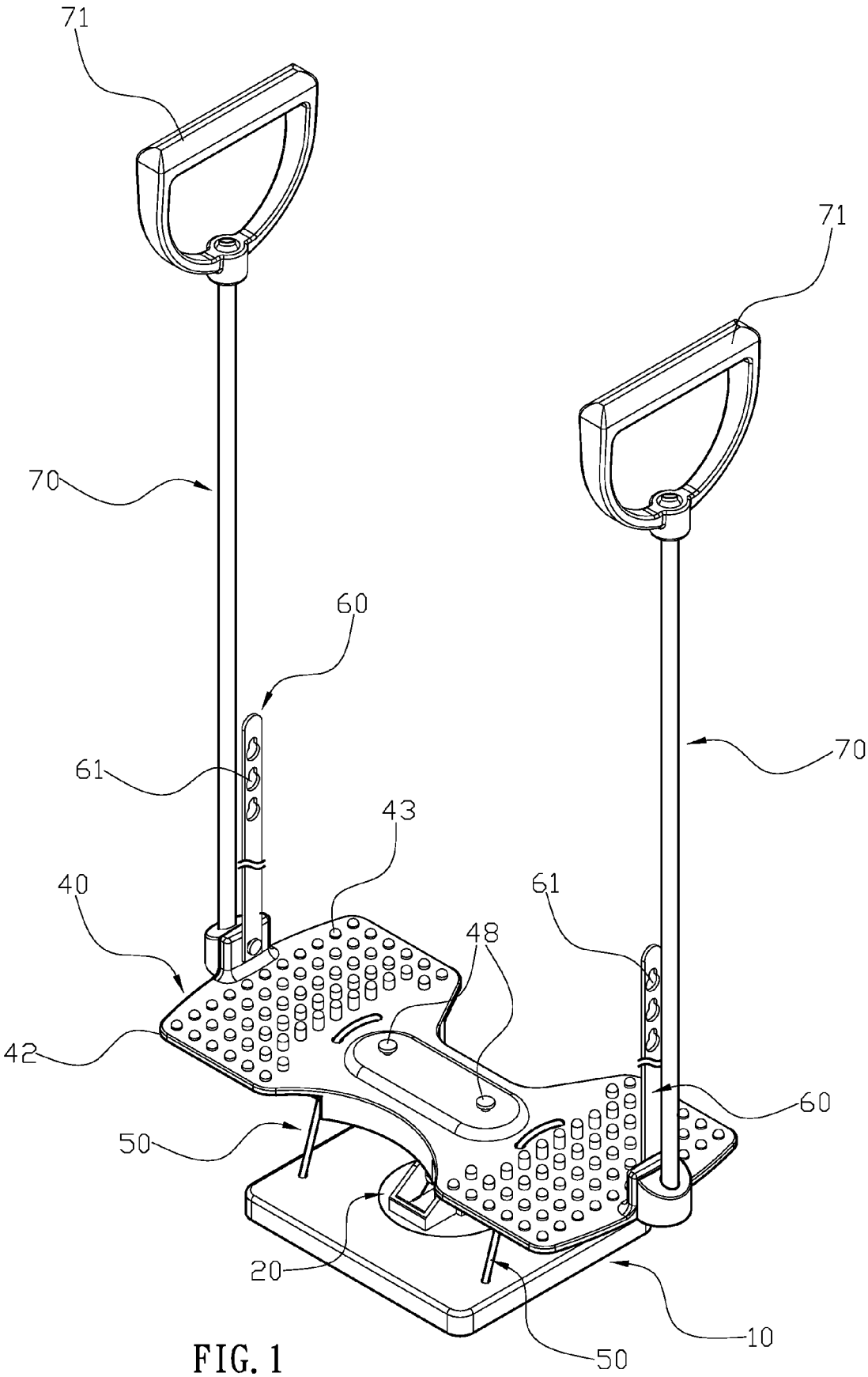
FIG. 1 is a perspective assembly of a preferred embodiment of the present invention.
Figures 2, 3:
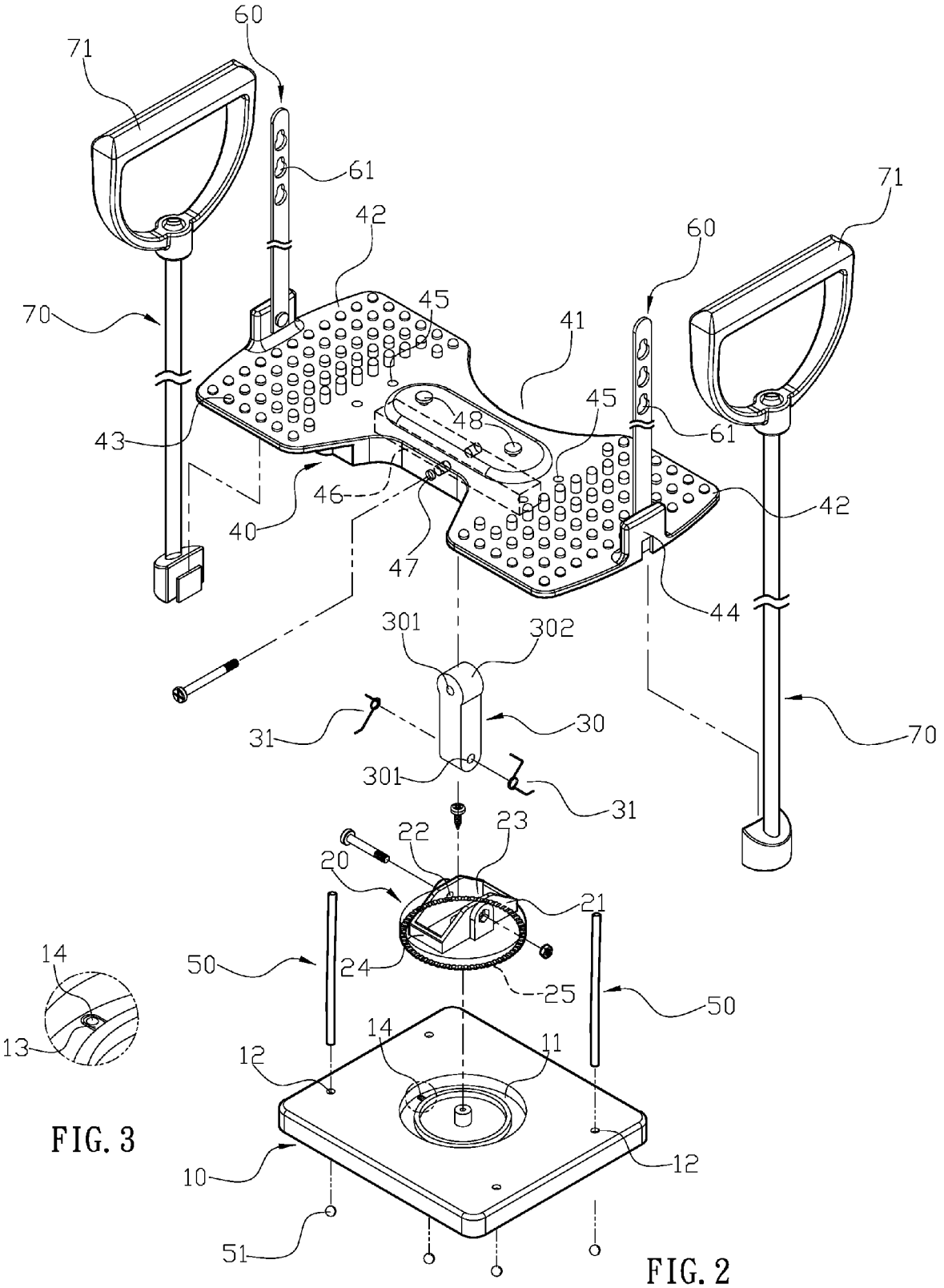
FIG. 2 is a perspective exploded of the preferred embodiment of the present invention.
FIG. 3 is a local detail drawing of FIG. 2 the preferred embodiment of the present invention.
Figure 4:
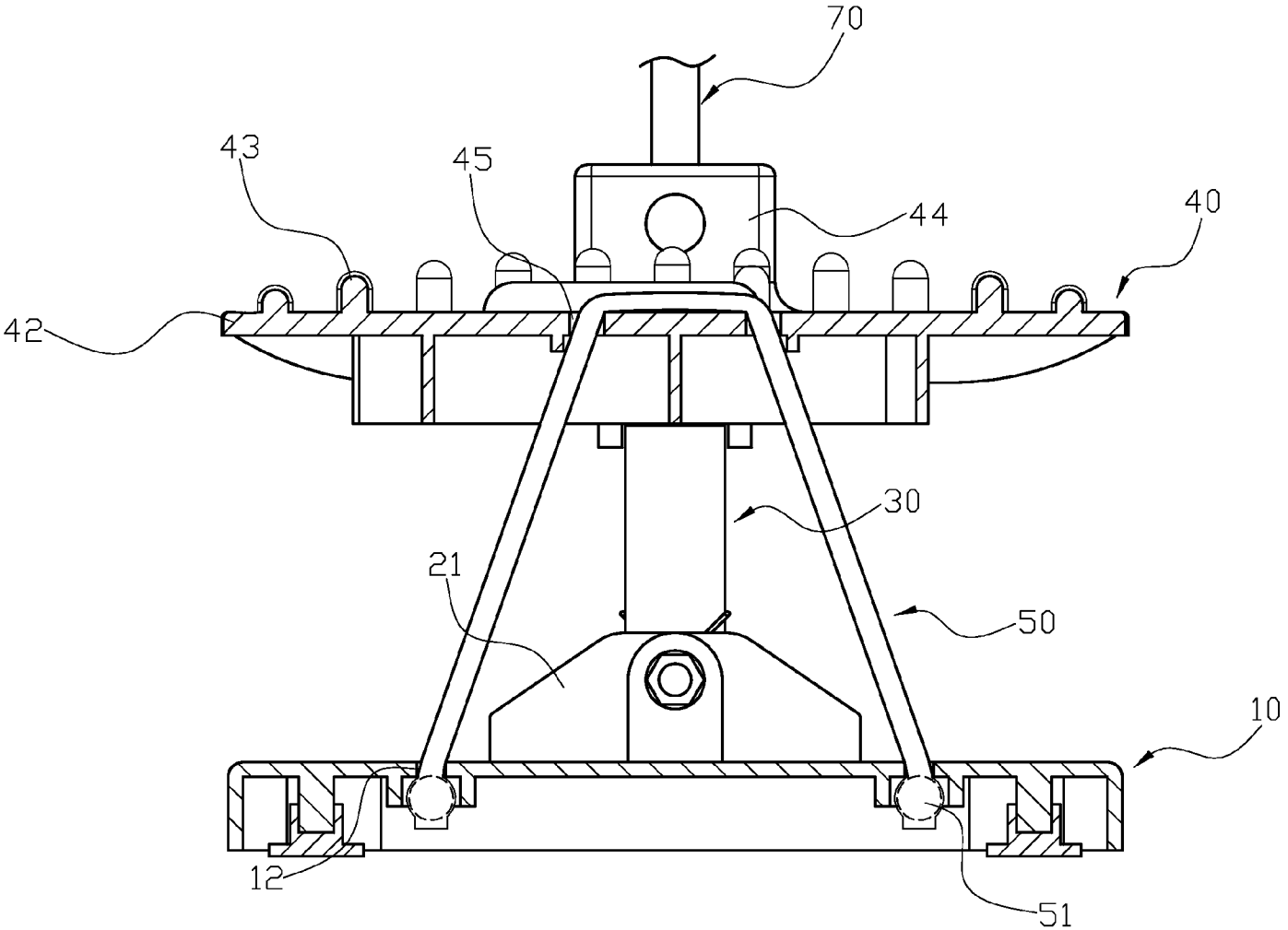
FIG. 4 is a cross-sectional assembly drawing of the preferred embodiment of the present invention.
Figure 5:
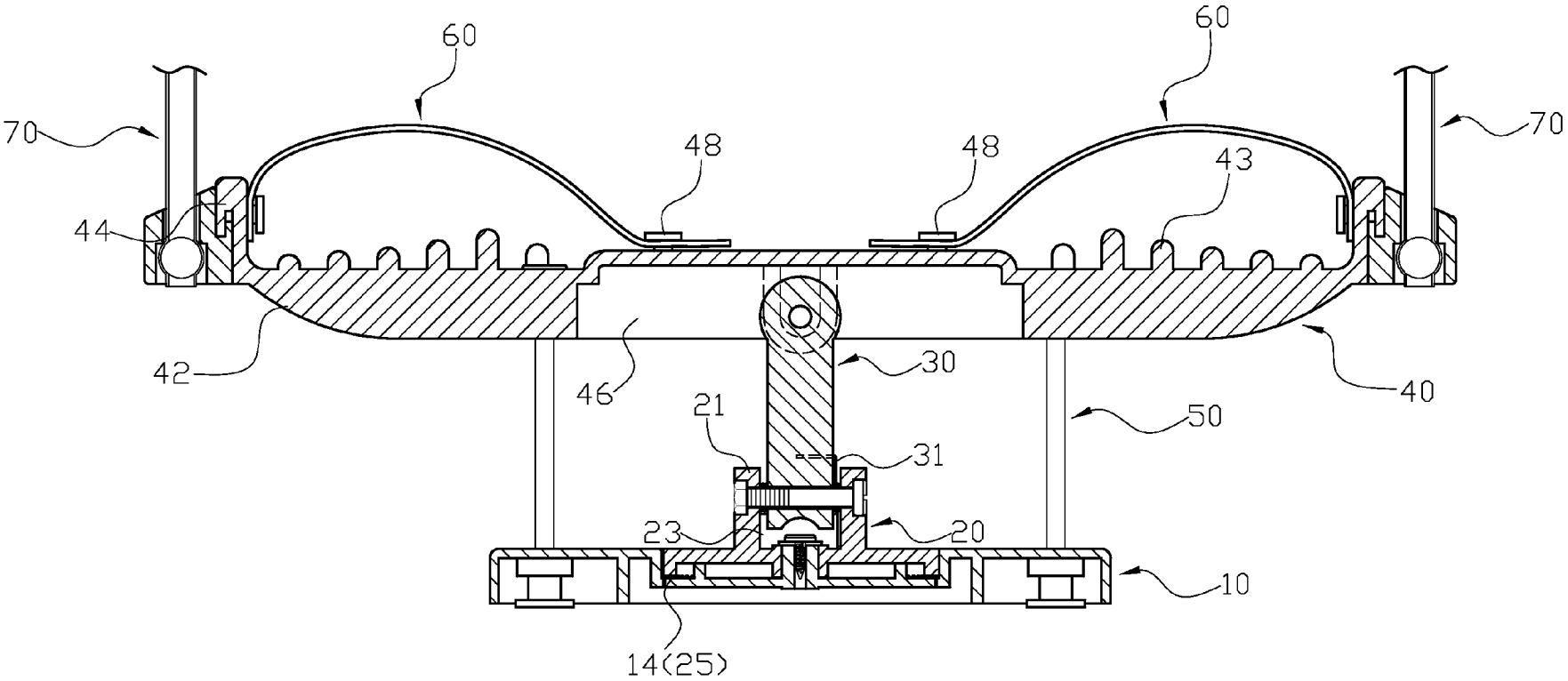
FIG. 5 is another cross-sectional assembly drawing of the preferred embodiment of the present invention.

Please refer to FIG. 1 to FIG. 5. The foot exercise machine comprises a base 10, a rotation disk 20, a linkage rod 30, a pedal 40, two elastic ropes 50, two elastic strips 60 and two elastic pulling strings 70. A chamber 11 is disposed on the base and the rotation disk 20 is pivotly mounted in the chamber 11. The base 10 has four securing apertures 12 respectively on four corners, each has a C-shaped indentation accepting an elastic sheet 13, and a positioning protrusion 14 is disposed on a top face of each elastic sheet 13. The rotation disk 20 is a rounded cap and has two opposite pivoting ears 21 having a pivoting aperture 22, such that an accepting space 23 is provided between the two pivoting ears 21. A stopping edge 24 is respectively provided at a front and rear of the pivoting ear 21. A plurality of positioning teeth 25 disposed around a bottom periphery of the rotation disk 20, which makes contact with the positioning protrusion 14 of the elastic sheet 13. Two ends of the linkage rod 30 are respectively provided with a pivoting aperture 301 with a direction perpendicular with each other, and one end of the linkage rod 30 is inserted into the accepting space 23 of the rotation disk 20 and attached with two torsion springs 31 at two sides, a pivoting shaft is inserted through the pivoting apertures 22, 301 and the torsion springs 31 to secure the linkage rod 30 onto the pivoting ear 21 of the rotation disk 20 and maintain the linkage rod 30 up vertically. The end of the linkage rod 30 pivoted onto the pedal 40 is provided with an enlarged resting edge 302.

A dividing opening 41 is respectively provided 40 at a front and rear central region of the pedal 40, with dividing openings 41, two stepping areas 42 are respectively formed in two sides of the pedal 40. A plurality of protruding point 43 are provided on a top surface of the stepping area 42. Each stepping area 42 has an engaging portion 44 at an outer edge and two through apertures 45 at an inner portion. A long slot 46 is provided at a central area of a bottom side of the pedal 40, and a pivoting aperture 47 is provided through the long slot 46 at a central area of the pedal 40. Another end having the resting edge 302 of the linkage rod is accepted in the long slot 46 and a pivoting shaft is placed through the pivoting aperture 47, 301 such that the pedal 40 is positioned off set from the base 10. The elastic rope 50 can be made of rubber. Two ends of the elastic rope 50 are respectively placed through the two through apertures 45 of the pedal 40 and the two securing apertures 12 of the base 10 and respectively have an enlarged portion 51. The enlarged portion 51 is formed by the elastic rope covering at least one ball or formed by a knot on the elastic rope 50. One end of the elastic strip 60 is secured onto the engaging portion 44 of the pedal 40 and another free end has a plurality of adjusting apertures 61 corresponding to at least one fastening protrusion 48 on the pedal 40. One end of the elastic pulling string 70 is fastened onto the engaging portion 44 of the pedal 40 and another end is provided with a gripping loop 71.

Figure 6:
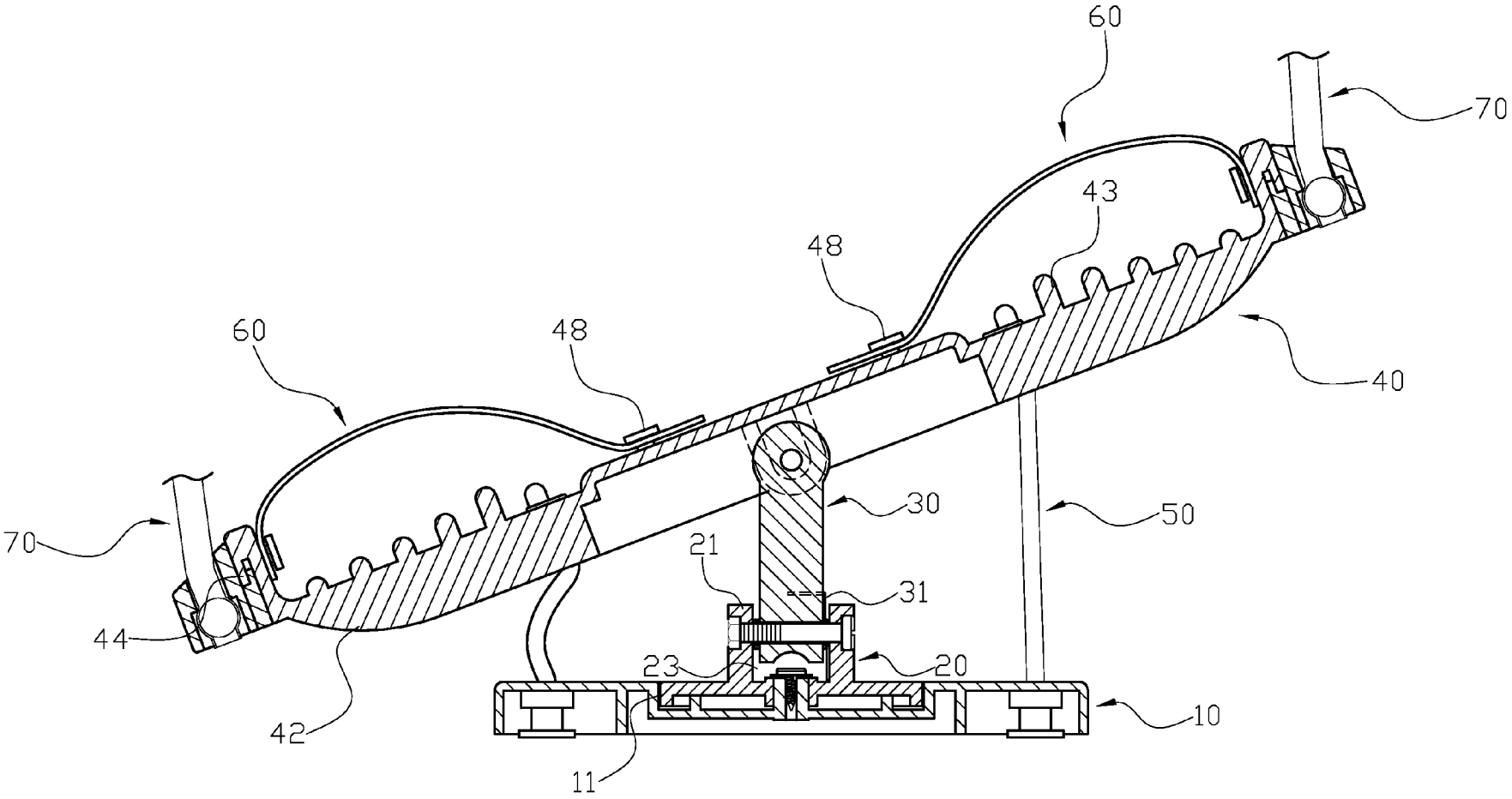
FIG. 6 is a cross-sectional assembly drawing of showing the embodiment being pressed down.
Figure 7:
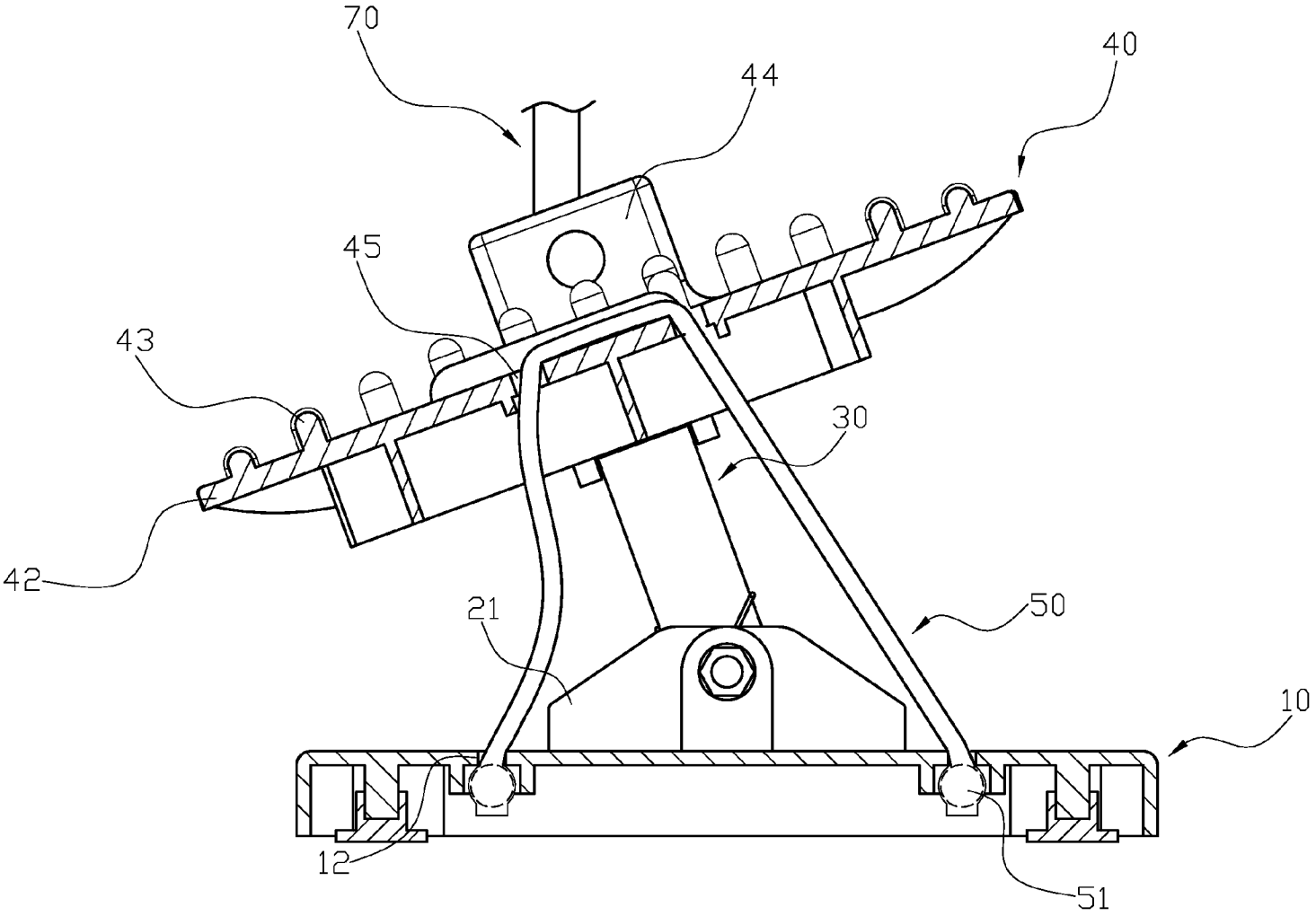
FIG. 7 is another cross-sectional assembly drawing of showing the embodiment being pressed down.

For actual usage, a user sits down and places both foot on the two stepping area 42 of the pedal 40. The user needs to press down with two foot in turns to make the pedal 40 to swing left and right due to the connection between linkage rod 30 and the base 10, and pull on the elastic rope 50, as shown in FIG. 6 and FIG. 7. Meanwhile, with the connection among the base 10, the rotation disk 20 and the pedal 40, the pedal 40 can also provide rotation, which can helps the protruding point 43 to provide massaging effect.

Furthermore, with the elastic strip 60 and the fastening protrusion 48, the user can straddle his or her foot onto the pedal 40 to avoid the foot from slipping. When the pedal 40 is rotated, the positioning teeth 25 engage with the positioning protrusion 14 to avoid the rotation disk 20 from disengaging.

Figure 8:
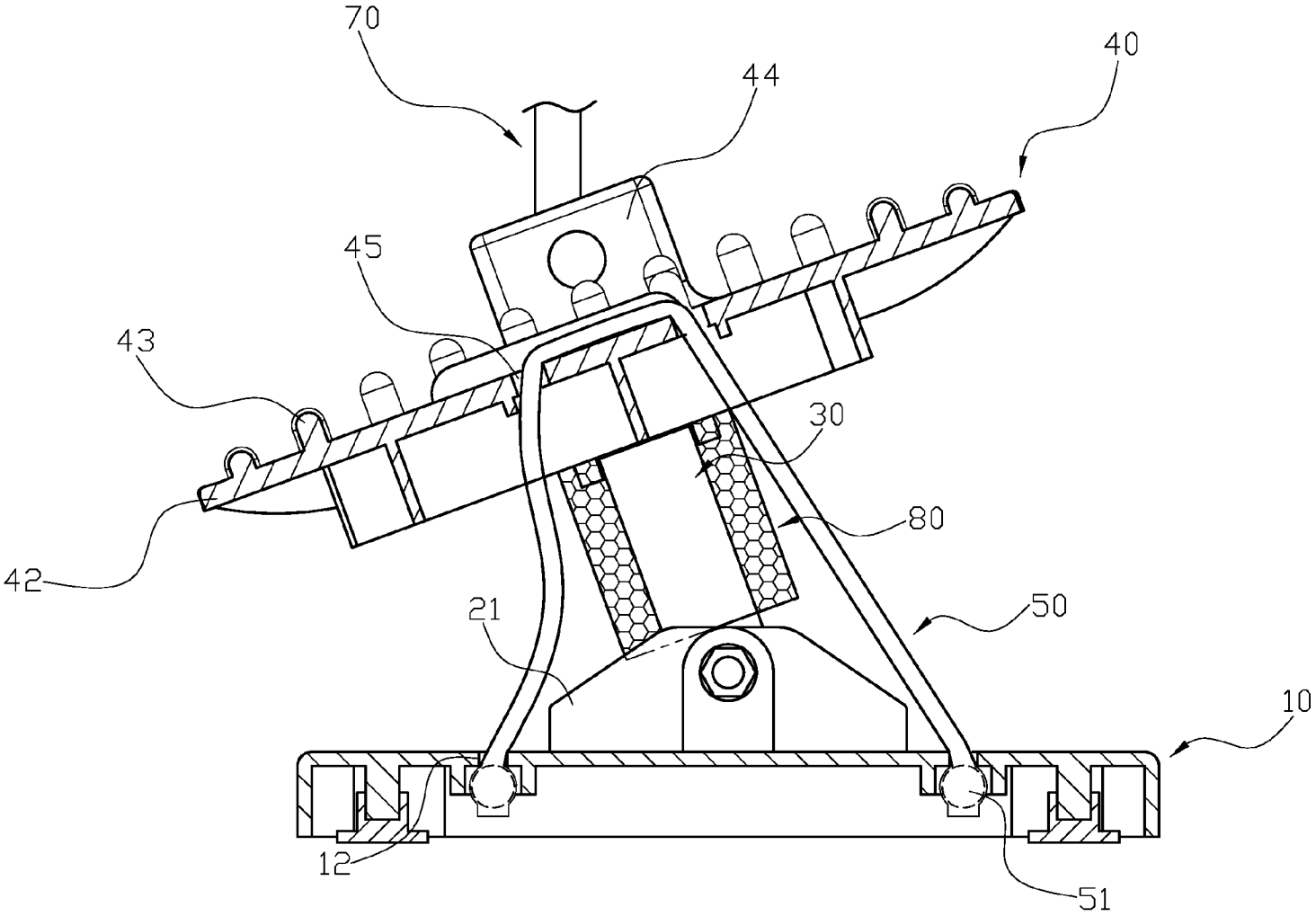
FIG. 8 is a schematic drawing of another embodiment of the present invention.

Please refer to FIG. 8. The linkage rod 30 is covered by a flexible member, and the flexible member 80 is a hollow tube made of polyurethane foam. The flexible member 80 increases the resistance preventing the pedal 40 being pressed downwardly. In addition, the flexible member 80 can avoid noise during exercise.

With above-mentioned structure, following benefits can be obtained: 1. The foot exercise machine having simple structure and light weight. 2. The manufacturing cost of the foot exercise machine is lower so it is more approachable for everyone. 3. The foot exercise machine can also improve user's balance skill.

Although the present invention has been explained in relation to its preferred embodiment, it is to be understood that many other possible modifications and variations can be made without departing from the spirit and scope of the invention as hereinafter claimed.

What is claimed is:

1. A foot exercise machine comprising a base, a rotation disk, a linkage rod, a pedal, two elastic ropes, two elastic strips and two elastic pulling strings, wherein:

a chamber is disposed on the base and the rotation disk is pivotly mounted in the chamber; the base has at least four securing apertures respectively positioned on four corners, each having a C-shaped indentation accepting an elastic sheet; and a positioning protrusion is disposed on a top face of the elastic sheet;

the rotation disk is a rounded cap and has two opposite pivoting ears, each pivoting ear having a pivoting aperture; an accepting space is provided between the two opposite pivoting ears; a plurality of positioning teeth are disposed around a bottom periphery of the rotation disk and make contact with the positioning protrusion of the elastic sheet;

a first end of the linkage rod is provided with a first linkage rod pivoting aperture; a second end of the linkage rod is provided with a second linkage rod pivoting aperture; the first linkage rod pivoting aperture having a direction perpendicular to a direction of the second linkage rod pivoting aperture; the first end of the linkage rod is inserted into the accepting space of the rotation disk and attached with at least two torsion springs on at least two sides of the linkage rod, a first pivoting shaft is inserted through the first linkage rod pivoting aperture and the torsion springs secure the linkage rod onto the pivoting ear of the rotation disk and maintain the linkage rod vertically;

two sides of the pedal are each provided with a stepping area; each stepping area has an engaging portion at an outer edge and at least two through apertures at an inner portion; a slot is provided at a central area of a bottom side of the pedal; a pedal pivoting aperture is provided through the slot at a central area of the pedal, the second end of the linkage rod is accepted in the slot and a second pivoting shaft is placed through the pedal pivoting aperture such that the pedal is positioned off set from the base;

two ends of each of the two elastic ropes are respectively placed through the two through apertures of each of the stepping areas of the pedal and the two of the at least four securing apertures of the base; each end of the two elastic ropes has an enlarged portion;

one end of each of the two elastic strips is secured onto the engaging portion of the pedal and a free end of each of the two elastic strips has a plurality of adjusting apertures corresponding to at least one fastening protrusion on the pedal; and one end of each of the two elastic pulling strings is fastened onto the engaging portion of the pedal and another end is provided with a gripping loop.

2. The foot exercise machine as claimed in claim 1, wherein a first stopping edge is provided at a front of the pivoting ears, and a second stopping edge is provided at a rear of the pivoting ears.

3. The foot exercise machine as claimed in claim 1, wherein the second end of the linkage rod is provided with an enlarged resting edge.

4. The foot exercise machine as claimed in claim 1, wherein two dividing openings are respectively provided at a front central region and rear central region of the pedal, and two stepping areas are respectively formed in two sides of the pedal.

5. The foot exercise machine as claimed in claim 1, wherein a plurality of protruding points are provided on a top surface of each stepping area.

6. The foot exercise machine as claimed in claim 1, wherein each enlarged portion is formed by the elastic rope covering at least one ball.

7. The foot exercise machine as claimed in claim 1, wherein each enlarged portion is formed by a knot on the elastic rope.

8. The foot exercise machine as claimed in claim 1, wherein the linkage rod is covered by a flexible member.

9. The foot exercise machine as claimed in claim 8, wherein the flexible member is a hollow tube made of polyurethane foam.

10. The foot exercise machine as claimed in claim 8, wherein the flexible member is compressed spring.

* * * * *